US008770216B2

(12) United States Patent
Yang et al.

(10) Patent No.: US 8,770,216 B2
(45) Date of Patent: Jul. 8, 2014

(54) DEVICE ADAPTED TO WITHDRAW GAS AND TO CONTROL GAS FLOW RATE DISCHARGED THEREFROM

(75) Inventors: Cheng-Nan Yang, Taichung (TW); Lung-Yin Lin, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 243 days.

(21) Appl. No.: 13/409,279

(22) Filed: Mar. 1, 2012

(65) Prior Publication Data

US 2013/0228243 A1 Sep. 5, 2013

(51) Int. Cl.
*F24D 19/08* (2006.01)

(52) U.S. Cl.
USPC ..... 137/197; 137/321; 141/3; 141/20; 431/321; 222/3; 222/402.16

(58) Field of Classification Search
USPC ..... 137/197, 590; 222/3, 402.16, 399, 222/402.1; 141/3, 20, 18, 110–112; 431/321
See application file for complete search history.

(56) References Cited

U.S. PATENT DOCUMENTS

| | | | | | |
|---|---|---|---|---|---|
| 2,882,940 | A * | 4/1959 | Zellweger | 141/293 |
| 3,118,295 | A * | 1/1964 | Van Poppel | 222/3 |
| 3,141,317 | A * | 7/1964 | Segawa | 62/48.4 |
| 3,399,951 | A * | 9/1968 | Koizumi | 431/344 |
| 3,533,721 | A * | 10/1970 | Hocq | 431/344 |
| 3,705,785 | A * | 12/1972 | Goto | 431/344 |
| 4,680,007 | A * | 7/1987 | Schachter | 431/344 |
| 4,729,949 | A * | 3/1988 | Weinreb et al. | 435/30 |
| 5,348,467 | A * | 9/1994 | Piffath et al. | 431/153 |
| 2009/0008584 | A1 * | 1/2009 | Fontela et al. | 251/118 |

FOREIGN PATENT DOCUMENTS

TW I269011 B 12/2006

* cited by examiner

*Primary Examiner* — Elizabeth Houston
*Assistant Examiner* — Ian Paquette
(74) *Attorney, Agent, or Firm* — Alan Kamrath; Kamrath IP Lawfirm, P.A.

(57) ABSTRACT

A device includes a filling valve, a sleeve, an absorbing member, and a gas control unit. The filling valve can be engaged for filling liquid gas. The sleeve includes a fluid passing section that enables liquid gas outside to flow therein. The absorbing member can absorb liquid gas and is disposed in the sleeve. The gas control unit includes a main body, a gas inlet and flow rate adjusting mechanism, and a gas outlet mechanism. The gas inlet and flow rate adjusting mechanism includes an adjustably movable valve and a first air seal. The first air seal is mounted between the adjustably movable valve and the main body to prevent liquid gas from passing therebetween. The adjustably movable valve is in fluid communication with the gas outlet mechanism such that vaporized gas emitted from the absorbing member is discharged from the device from the gas outlet mechanism.

14 Claims, 10 Drawing Sheets

DEVICE ADAPTED TO WITHDRAW GAS AND TO CONTROL GAS FLOW RATE DISCHARGED THEREFROM

BACKGROUND OF THE INVENTION

1. Field of the Invention

The present invention relates to a device adapted to withdraw gas and to control the gas flow rate discharged therefrom.

2. Description of the Related Art

Conventionally, when a gas device overfilled with liquid gas is ignited, it often suffers a problem that liquid gas is not completely vaporized and discharged. As such, there are some dealers who fill up one third of a gas reservoir in a gas device in order to prevent incompletely vaporized gas from flowing out. However, it is a waste of gas storage space.

TW Patent No. 1269011 teaches a gas device that can limit an amount of liquid gas inside such that a user knows to stop filling liquid gas when excessive liquid gas flows out of the gas device. Although there is less waste of gas storage space, it is desirable to avoid less waste of gas storage space while preventing incompletely vaporized gas from flowing out.

The present invention is, therefore, intended to obviate or at least alleviate the problems encountered in the prior art.

SUMMARY OF THE INVENTION

According to the present invention, a device adapted to withdraw gas and to control the gas flow rate discharged therefrom includes a filling valve, a sleeve, an absorbing member, and a gas control unit. The filling valve is initially in a shut position and adapted to be engaged to move to an open position for filling liquid gas. The sleeve has a hollow shape and includes a fluid passing section that enables liquid gas outside to flow therein. The absorbing member having an ability to absorb liquid gas is disposed in the sleeve. The gas control unit includes a main body, a gas inlet and flow rate adjusting mechanism, and a gas outlet mechanism. The main body includes one end receiving the gas inlet and flow rate adjusting mechanism and another end receiving the gas outlet mechanism respectively. The gas inlet and flow rate adjusting mechanism includes an adjustably movable valve and a first air seal. The first air seal is mounted between the adjustably movable valve and the main body to prevent liquid gas from passing therebetween. Moreover, the gas inlet and flow rate adjusting mechanism includes the adjustably movable valve including an end engaged with the sleeve and the absorbing member. Thus, after the absorbing member absorbs liquid gas outside the sleeve through the fluid passing section, vaporized gas emitted from the absorbing member is able to flow into the adjustably movable valve. Also, the adjustably movable valve is in fluid communication with the gas outlet mechanism, such that vaporized gas is discharged from the device from the gas outlet mechanism.

It is an object of the present invention to provide a device adapted to withdraw liquid gas and to discharge complete vaporized gas.

It is also an object of the present invention to provide a device that can adjust the flow rate of the gas.

It is another object of the present invention to provide a device that can save a waste of gas storage space.

It is yet another object of the present invention to provide a device that can prevent incompletely vaporized gas from flowing out.

Other objects, advantages, and new features of the present invention will become apparent from the following detailed description of the invention when considered in conjunction with the accompanied drawings.

DETAILED DESCRIPTION OF THE PREFERRED EMBODIMENTS

Figure 1:
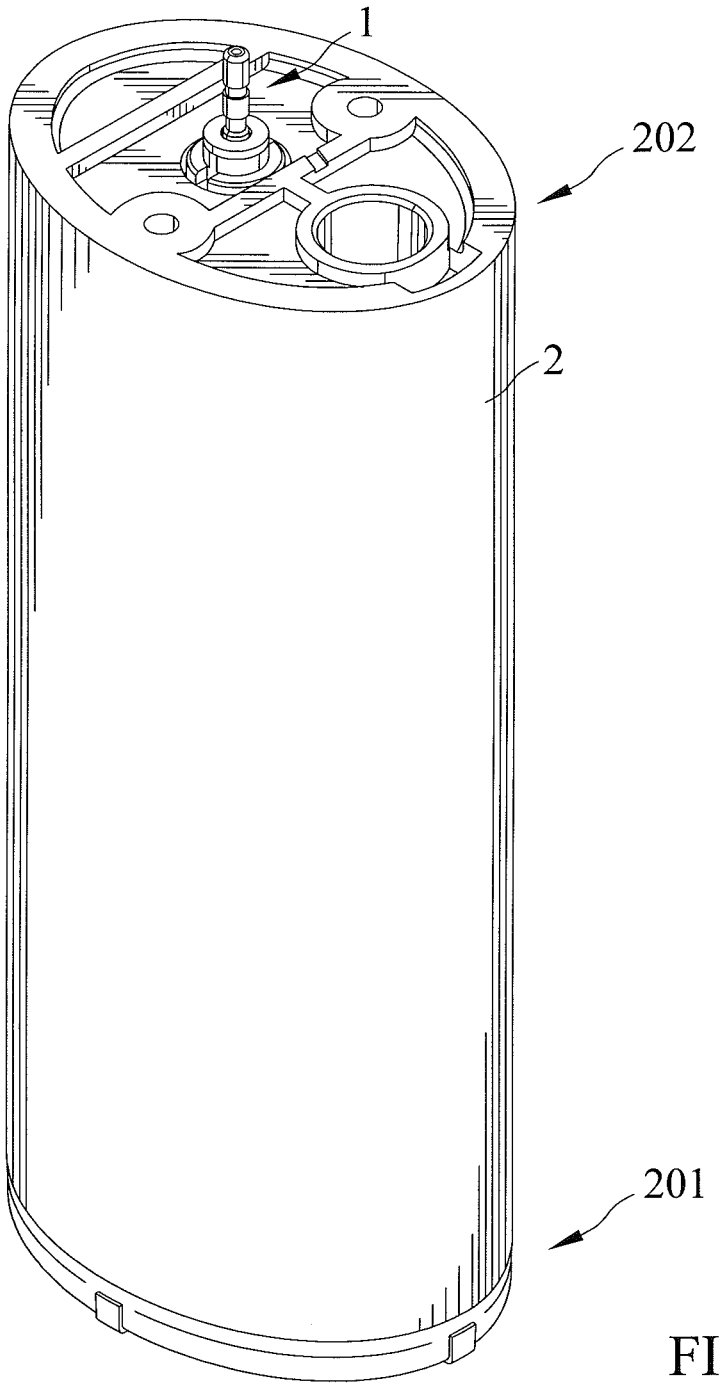
FIG. 1 is a perspective view of a device adapted to withdraw gas and to control the gas flow rate discharged therefrom in accordance with a first embodiment of the present invention, with the device received in a can.
Figure 2:
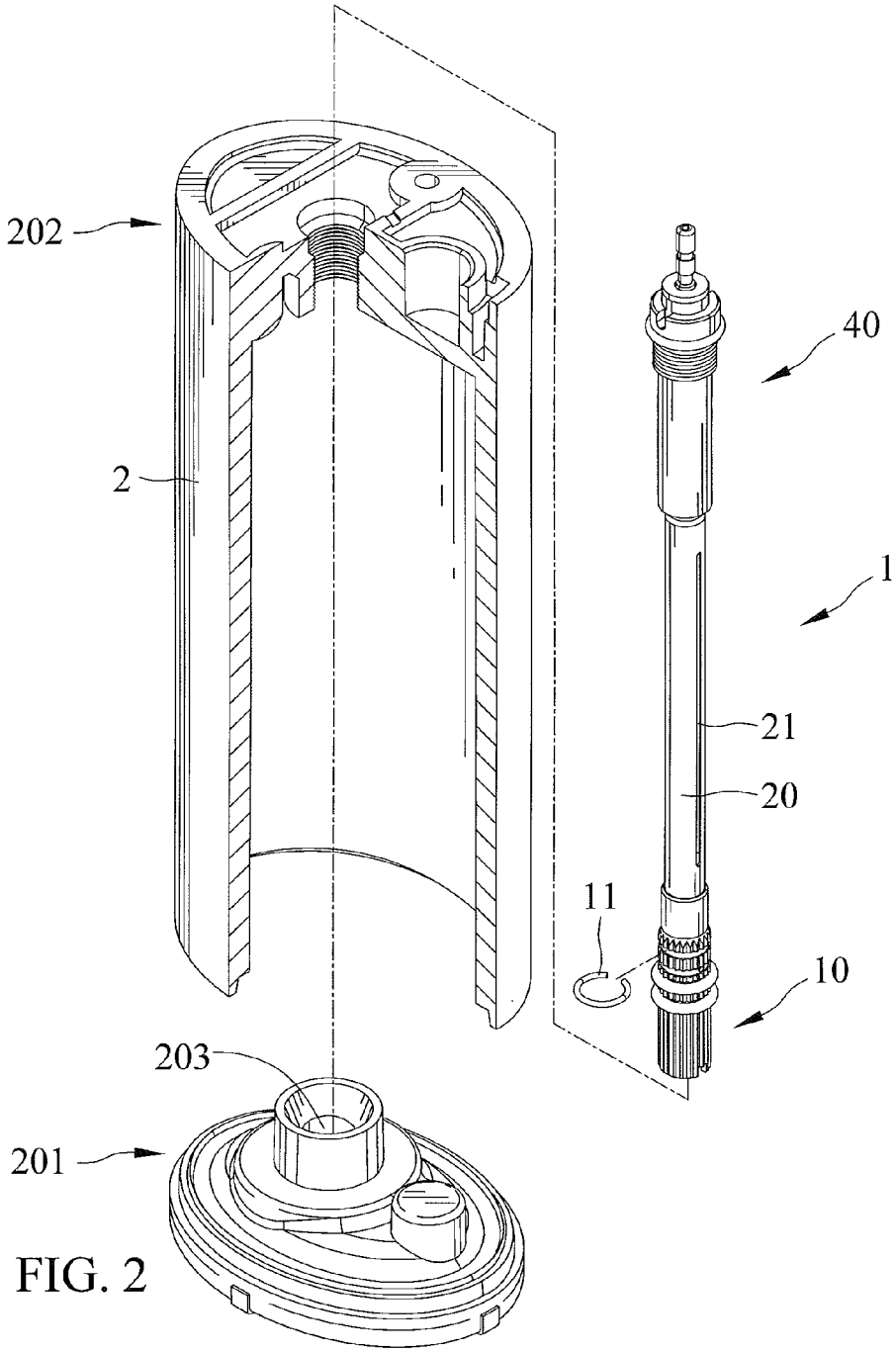
FIG. 2 is an exploded perspective view of FIG. 1.
Figure 3:
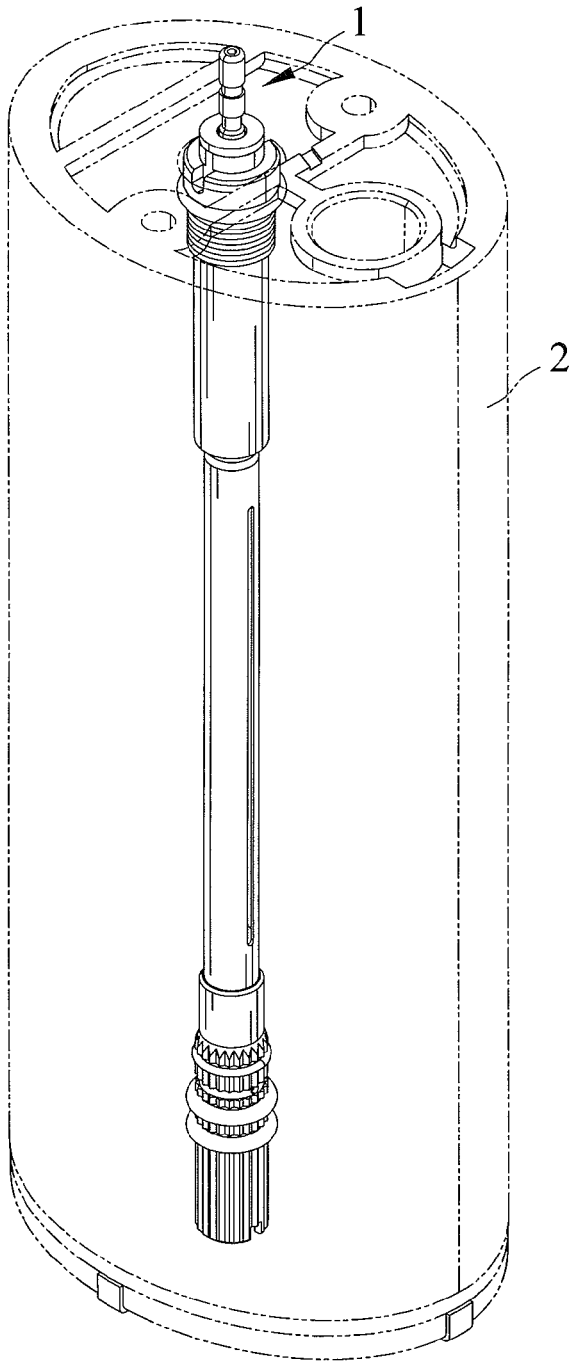
FIG. 3 is similar to FIG. 1, except that the can is shown in phantom.
Figure 4:
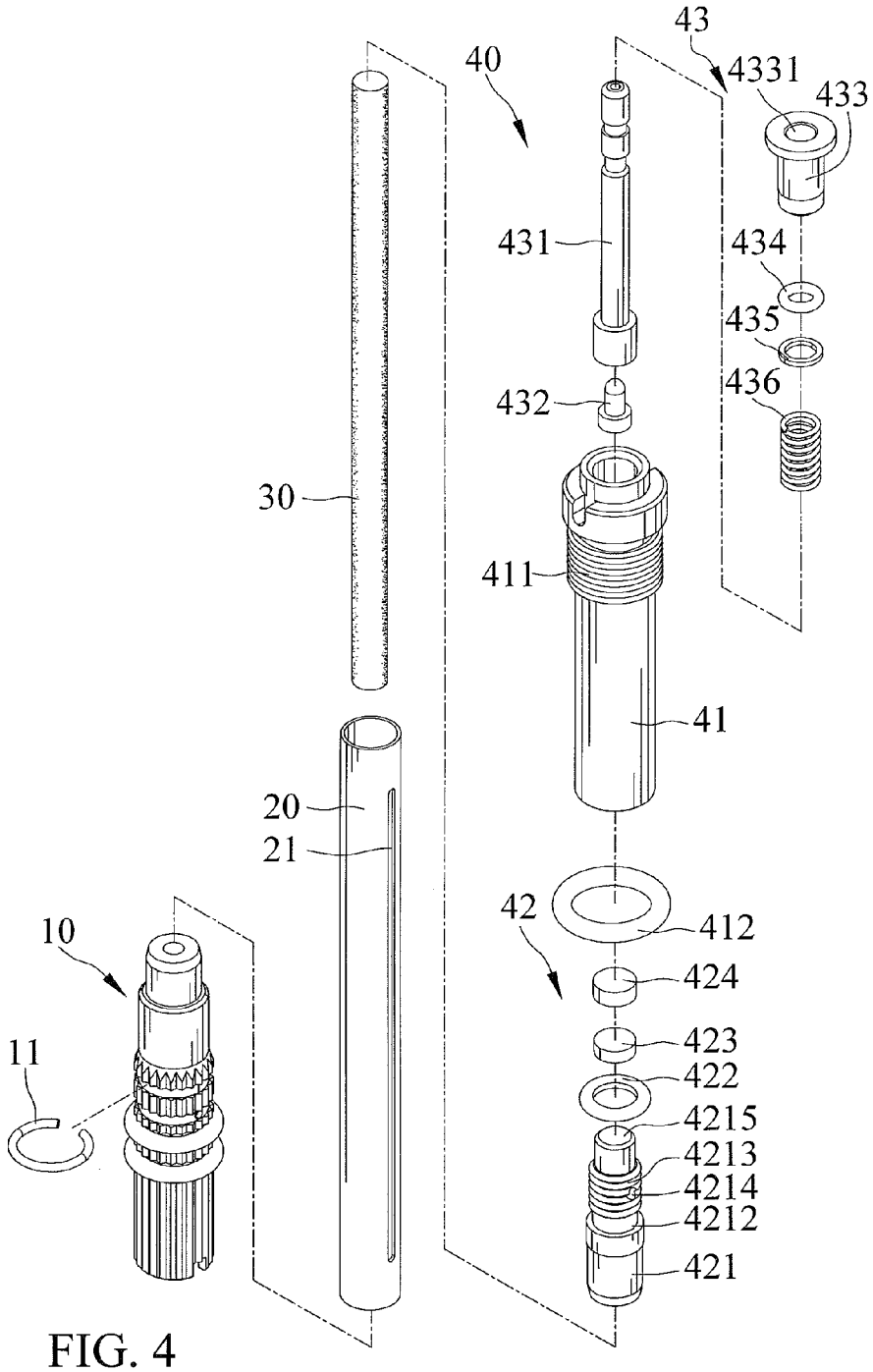
FIG. 4 is an exploded perspective view of the device shown in FIG. 1.
Figure 5:
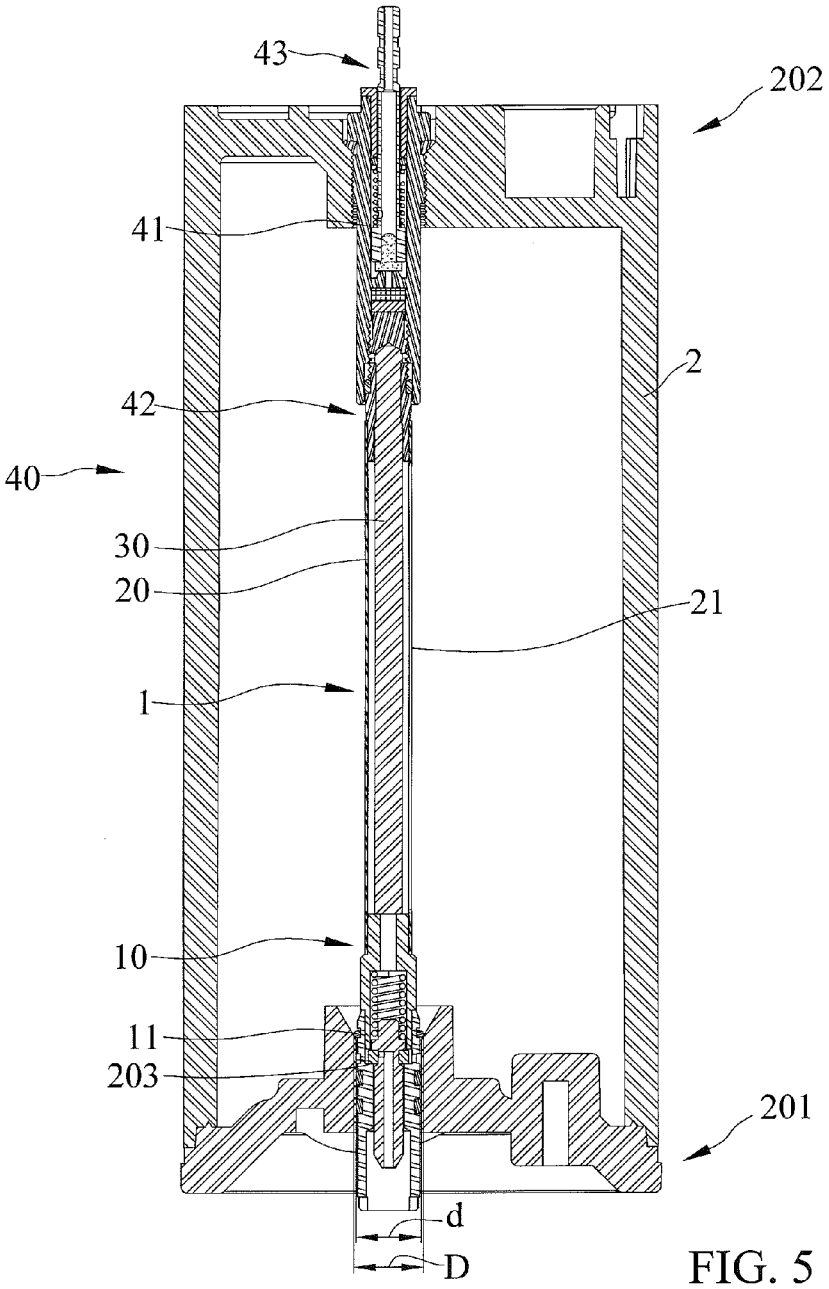
FIG. 5 is a cross-sectional view of FIG. 1.
Figure 6:
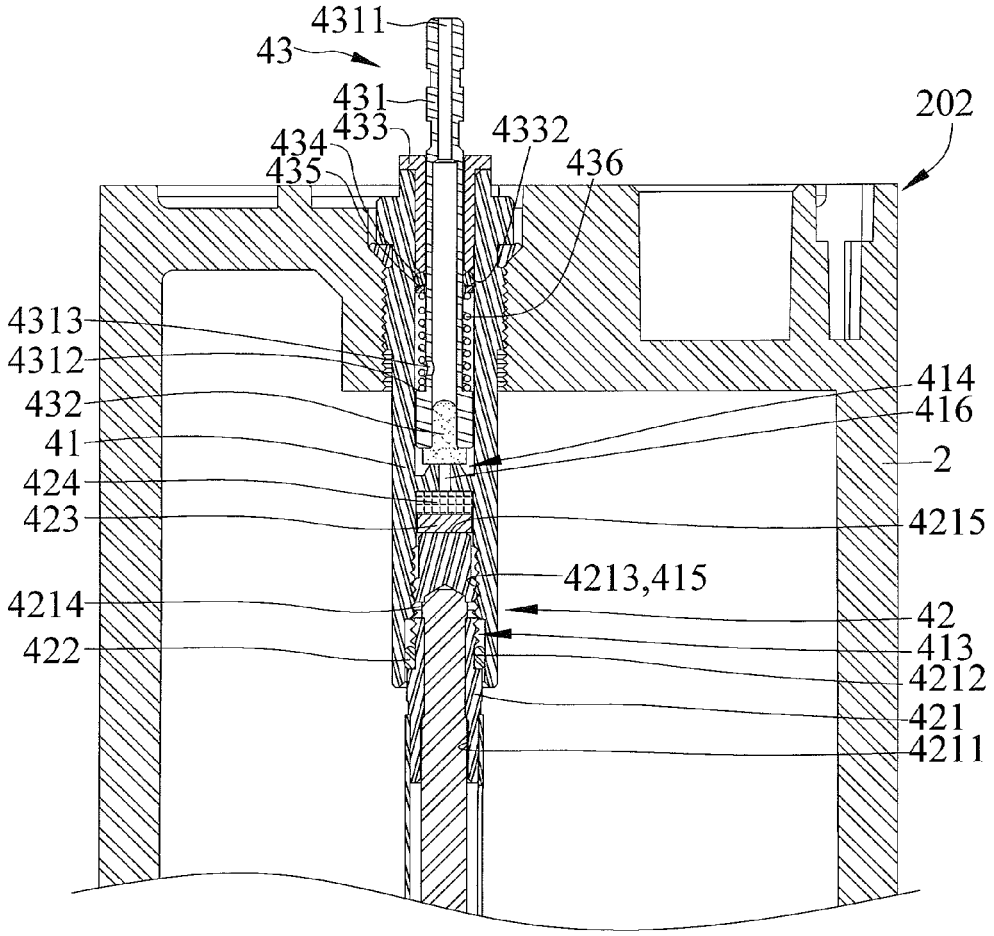
FIG. 6 is a partial, enlarged view of FIG. 5.
Figure 7:
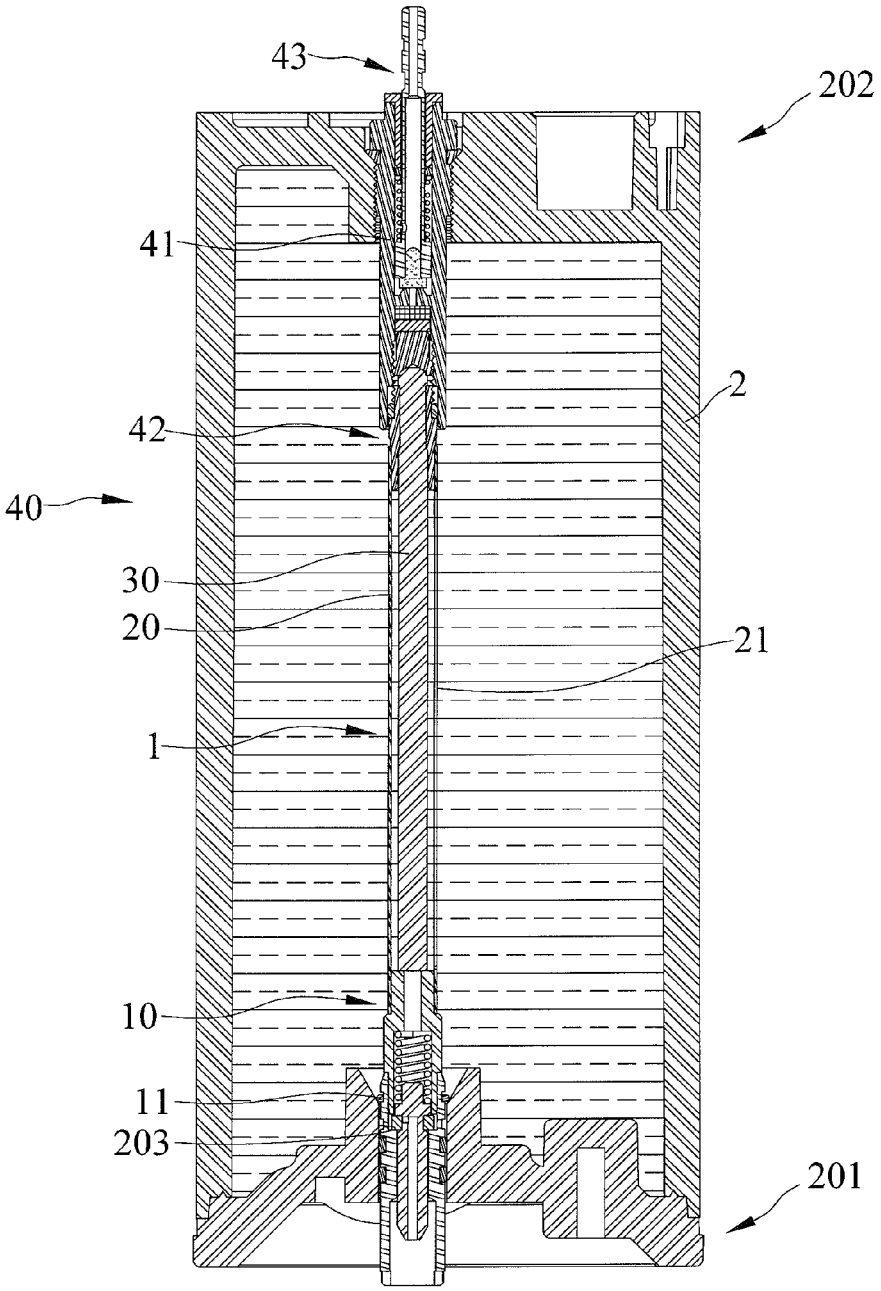
FIG. 7 is a cross-sectional view showing the can filled with gas.
Figure 8:
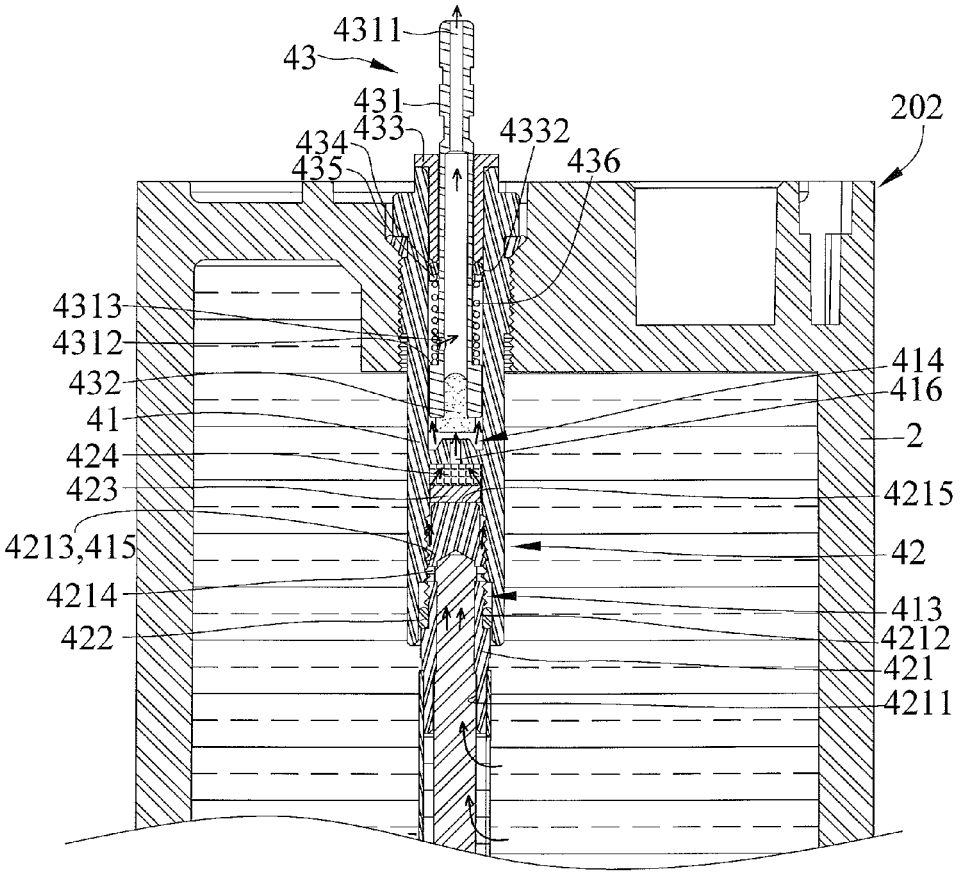
FIG. 8 is a partial, enlarged view of FIG. 7, with arrows indicating the device in the process of withdrawing and discharging gas.

FIGS. 1 through 9 show a device 1 adapted to withdraw gas and to control the gas flow rate discharged therefrom in accordance with a first embodiment of the present invention. The device 1 adapted to withdraw gas and to control the gas flow rate discharged therefrom includes a filling valve 10, a sleeve 20, an absorbing member 30, and a gas control unit 40.

The filling valve 10 is initially in a shut position and adapted to be engaged to move to an open position for filling liquid gas.

The sleeve 20 has a hollow shape and includes an open end engaged with the filling valve 10, and a fluid passing section 21 that enables liquid gas outside the sleeve 20 to flow therein.

The absorbing member 30 having an ability to absorb liquid gas is disposed in the sleeve 20. The fluid passing section 21 is in the form of a slot, wherein the slot is extended axially along a longitudinal length of the sleeve 20. The absorbing member 30 includes an end abutted against the filling valve 10. The absorbing member 30 is solid and made of cotton.

The gas control unit 40 includes a main body 41, a gas inlet and flow rate adjusting mechanism 42, and a gas outlet mechanism 43. The main body 41 includes one end receiving the gas inlet and flow rate adjusting mechanism 42 and another end receiving the gas outlet mechanism 43 respectively. Moreover, the main body 41 includes first and second chambers 413 and 414, and a passage 416. The first and second chambers 413 and 414 are interconnected by the passage 416. The first and second chambers 413 and 414 are defined in two ends of the main body 41 respectively. The first chamber 413 receives the gas inlet and flow rate adjusting mechanism 42 and the second chamber 414 receives the gas outlet mechanism 43 respectively. The gas inlet and flow rate adjusting mechanism 42 includes an adjustably movable valve 421, a first air seal 422, a hard member 423, and a soft member 424. The adjustably movable valve 421 is adjustably mounted on the main body 41. Additionally, the main body 41 defines a first adjustment portion 415, and the adjustably movable valve 421 defines a second adjustment portion 4213, respectively. An inner thread defines the first adjustment portion 415, and an outer thread defines the second adjustment portion 4213, respectively. The first and second adjustment portions 415 and 4213 are engaged with each other, such that the adjustably movable valve 421 has various relative positions with respect to the main body 41. The adjustably movable valve 421 includes an end engaged with the sleeve 20 and the absorbing member 30, such that after the absorbing member 30 absorbs liquid gas outside the sleeve 20 through the fluid passing section 21, vaporized gas emitted from the absorbing member 30 is able to flow into the adjustably movable valve 421. The adjustably movable valve 421 is in fluid communication with the gas outlet mechanism 43, such that vaporized gas is discharged from the device 1 from the gas outlet mechanism 43. The adjustably movable valve 421 also includes a groove 4212 extended thereon and receiving the first air seal 422. The first air seal 422 is mounted on an outer periphery of the adjustably movable valve 421. The first air seal 422 is received in a compartment defined in the first chamber 413 and has a constant diameter. Moreover, the first air seal 422 is movable therein when the adjustably movable valve 421 is adjusted. The hard and soft members 423 and 424 are disposed in the first chamber 413. The hard member 423 is made of copper. The adjustably movable valve 421 includes a receptacle 4211 extended therein and an aperture 4214 extended radially therethrough and in fluid communication with the receptacle 4211, and an end of the absorbing member 30 received in the receptacle 4211. Additionally, the adjustably movable valve 421 includes a surface defining a pressing end 4215. The pressing end 4215 is abutted against the hard member 423, and the hard member 423 is abutted against the soft member 424, respectively. The soft member 424 is made of foam. The soft member 424 is depressible by the adjustably movable valve 421 to have various heights and density, with different heights determining the flow rate of vaporized gas in the gas outlet mechanism 43. The first air seal 422 is mounted between the adjustably movable valve 421 and the main body 41 to prevent liquid gas from passing therebetween, thereby avoiding liquid gas to flow into the gas control unit 40 and flow out of the device 1. Moreover, the gas inlet and flow rate adjusting mechanism 42 includes the adjustably movable valve 421 including an end engaged with the sleeve 20 and the absorbing member 30, such that after the absorbing member 30 absorbs liquid gas outside the sleeve 20 through the fluid passing section, vaporized gas emitted from the absorbing member 30 is able to flow into the adjustably movable valve 421. Also, the adjustably movable valve 421 is in fluid communication with the gas outlet mechanism 43, such that vaporized gas is discharged from the device 1 from the gas outlet mechanism 43. The gas outlet mechanism 43 includes a valve stem 431, a plug 432, a stopper 433, a second air seal 434, a spacer 435, and a biasing member 436. The valve stem 431 has a hollow shape and defines a first channel 4311. The valve stem 431 defines a first stop edge 4312. The valve stem 431 includes a hole 4313 extended radially therethrough and in fluid communication with the channel 4311. The plug 432 is inserted in an open end of the valve stem 431. The plug 432 selectively blocks fluid communication between the gas outlet mechanism 43 and the passage 416. The biasing member 436 is retained between the spacer 435 and the first stop edge 4312. The stopper 433 has a hollow shape and defines a second channel 4331. The valve stem 431 is inserted through the second channel 4331. The stopper 433 is fixed to the main body 41. The stopper 433 defines a second stop edge 4332, and the second air seal 434 is retained between the second stop edge 4332 and the spacer 435. The biasing member 436 is a spring that includes a plurality of coils.

Further, a can 2 provides a gas storage space and defines a bottom 201 and a top 202. The device 1 is disposed in the can 2. The main body 41 includes an outer thread 411 in thread engagement with the top 202 of the can 2 such that the main body 41 is fixed to the can 2. The main body 41 also includes an O-ring 412 disposed on an outer periphery of the main body 41 and sealing an opening of the can 2 to prevent liquid gas leakage.

Furthermore, the can 2 includes a through hole 203 extended in the bottom 201. The filling valve 10 is disposed in the through hole 203. The filling valve 10 is prevented from being completely inserted through the through hole 203 and disengaged from the can 2. The through hole has a diameter d. The filling valve 10 includes an outer periphery including a stop structure 11 extended therefrom such that the filling valve 10 with the stop structure 11 extended therefrom has a diameter D greater than the diameter d of the through hole 203. In the embodiment, the stop structure 11 is a C-ring.

Figure 9:
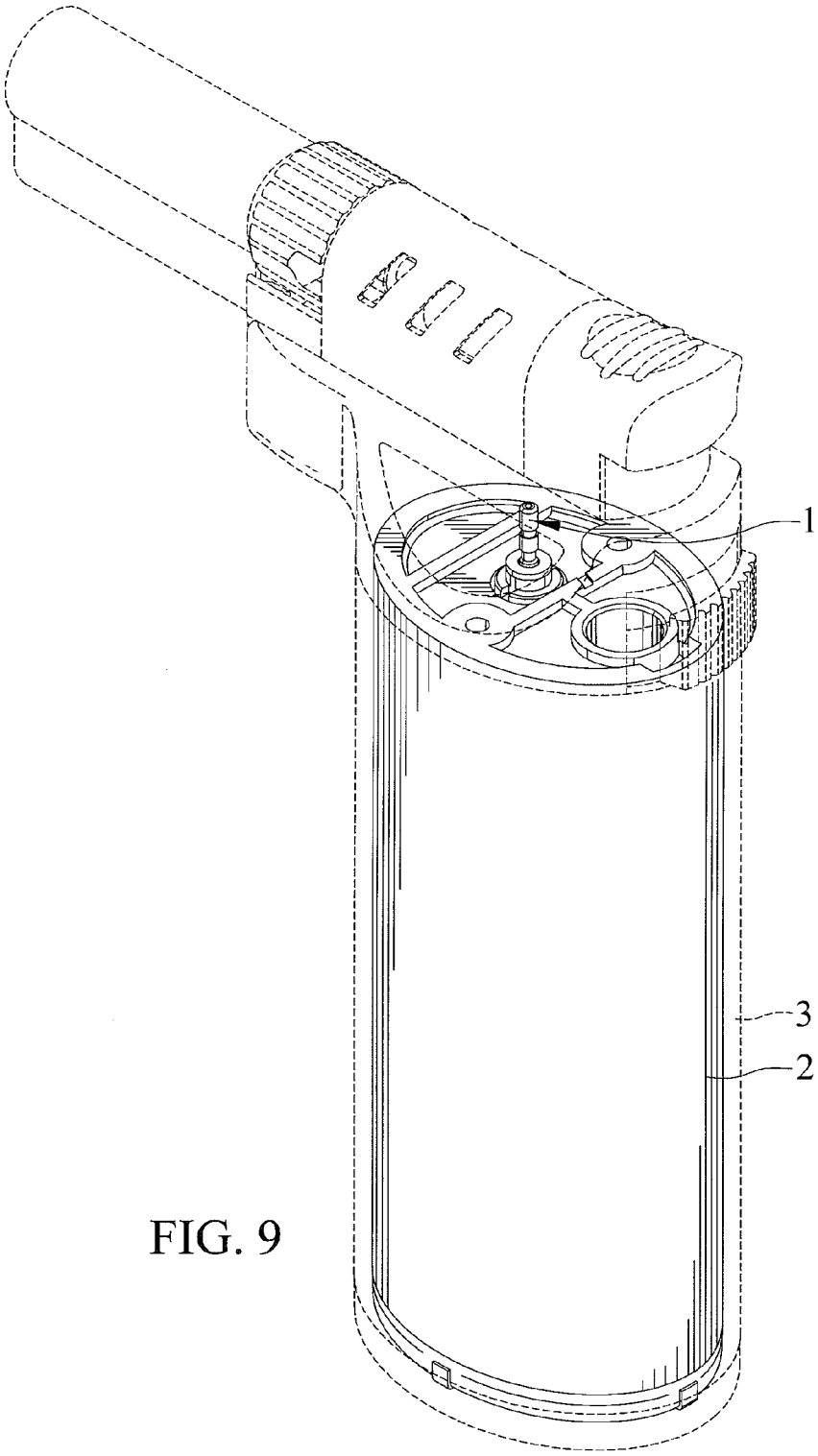
FIG. 9 shows the device and the can shown in FIG. 1 mounted in a gas device, with the gas device shown in phantom.

An application of the present invention is shown in FIG. 9. FIG. 9 shows the device 1 and can 2 mounted in a gas device.

Figure 10:
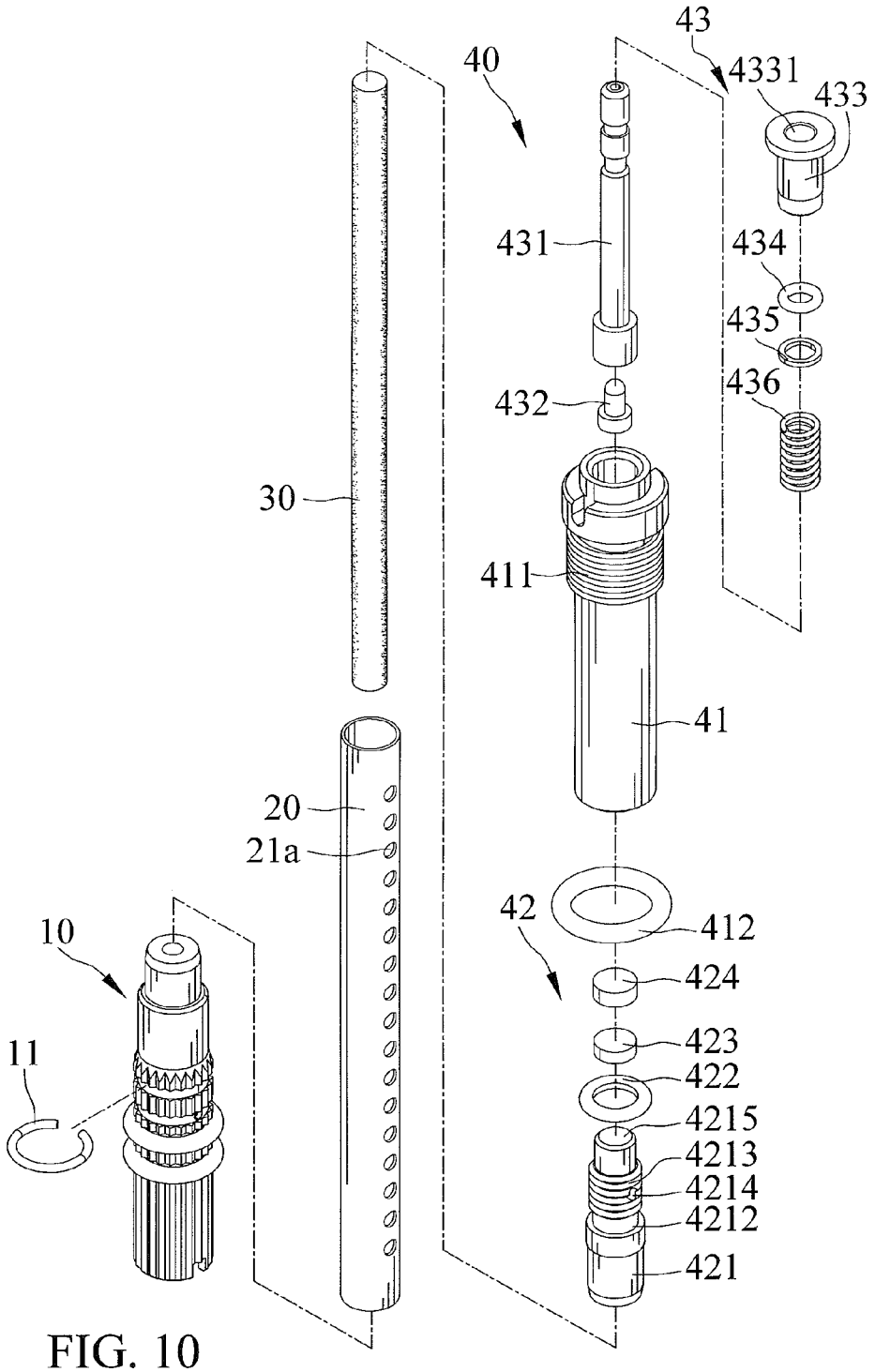
FIG. 10 is an exploded perspective view of a device adapted to withdraw gas and to control the gas flow rate discharged therefrom in accordance with a second embodiment of the present invention.

FIG. 10 shows a device adapted to withdraw gas and to control the gas flow rate discharged therefrom in accordance with a second embodiment of the present invention. The second embodiment is the same as the first embodiment, except that the sleeve 20 includes a fluid passing section 21*a* instead of the fluid passing section 21. The fluid passing section 21*a* is in the form of a plurality of holes. The plurality of holes is sequentially and axially disposed along a longitudinal length of the sleeve 20.

In view of the foregoing, liquid gas in the can 2 which is not completely vaporized can be prevented from being discharged from the device 1 and flowing into the gas outlet mechanism 43, no matter how the can 2 is tilted or is completely filled up with liquid gas. Therefore, the device 1 can avoid escape of liquid gas from the gas control unit 40, and a user will not suffer a problem of igniting liquid gas that can cause a sudden increase of flare activity.

While the specific embodiments have been illustrated and described, numerous modifications come to mind without significantly departing from the spirit of invention, and the scope of invention is only limited by the scope of the accompanying claims.

What is claimed is:

1. A device adapted to withdraw gas and to control the gas flow rate discharged therefrom comprising:

a filling valve initially in a shut position and adapted to be engaged to move to an open position for filling liquid gas; and a sleeve having a hollow shape and including an open end engaged with the filling valve, and a peripheral wall including a fluid passing zone that enables liquid gas outside the sleeve to flow inside;

an absorbing member having an ability to absorb liquid gas disposed in the sleeve;

a gas control unit including a main body, a gas inlet and flow rate adjusting mechanism, and a gas outlet mechanism, with the main body including one end receiving the gas inlet and flow rate adjusting mechanism and another end receiving the gas outlet mechanism respectively, with the main body including first and second chambers, and a passage, with the first and second chambers defined in two ends of the main body respectively, with the first chamber receiving the gas inlet and flow rate adjusting mechanism and the second chamber receiving the gas outlet mechanism respectively, with the first and second chambers interconnected by the passage, with the gas inlet and flow rate adjusting mechanism including an adjustably movable valve and a first air seal, with the adjustably movable valve adjustably mounted on the main body, with the first air seal mounted between the adjustably movable valve and the main body to prevent liquid gas from passing therebetween, with the adjustably movable valve including an end engaged with the sleeve and the absorbing member such that after the absorbing member absorbs liquid gas outside the sleeve through the fluid passing zone, vaporized gas emitted from the absorbing member is able to flow into the adjustably movable valve, with the adjustably movable valve in fluid communication with the gas outlet mechanism such that vaporized gas is discharged from the device from the gas outlet mechanism, wherein the adjustably movable valve includes a receptacle extended therein and an aperture extended radially therethrough and in fluid communication with the receptacle, with an end of the absorbing member received in the receptacle, with the gas inlet and flow rate adjusting mechanism including a soft member and a hard member disposed in the first chamber, with the soft member made of foam, with the soft member deressible by the adjustably movable valve to have various heights and density, with different heights determining the flow rate of vaporized gas in the gas outlet mechanism, with the hard member made of copper, with the adjustably movable valve including a surface defining a pressing end, with the pressing end abutted against the hard member and the hard member abutted against the soft member respectively; and a can providing a gas storage space and defining a bottom and a top, with the can including a through hole extended in the bottom, wherein the device is disposed in the can, with the filling valve disposed in the through hole, with the filling valve prevented from being completely inserted through the through hole and disengaged from the can, with the through hole having a diameter, with the filling valve including an outer periphery including a stop structure extended therefrom such that the filling valve with the stop structure extended therefrom has a diameter greater than the diameter of the through hole.

2. The device as claimed in claim 1, wherein the fluid passing zone is in the form of a slot, and wherein the slot is extended axially along a longitudinal length of the sleeve.

3. The device as claimed in claim 1, wherein the fluid passing zone is in the form of a plurality of holes, and wherein the plurality of holes is sequentially and axially disposed along a longitudinal length of the sleeve.

4. The device as claimed in claim 1, wherein the absorbing member includes an end abutted against the filling valve, and wherein the absorbing member is solid and made of cotton.

5. The device as claimed in claim 1, wherein the main body includes an outer thread and an O-ring, with the outer thread in thread engagement with the top of the can such that the main body is fixed to the can, and with the O-ring disposed on an outer periphery of the main body and sealing an opening of the can to prevent liquid gas leakage.

6. The device as claimed in claim 1, wherein the adjustably movable valve includes a receptacle extended therein and an aperture extended radially therethrough and in fluid communication with the receptacle, with an end of the absorbing member received in the receptacle.

7. The device as claimed in claim 1, wherein the gas outlet mechanism includes a valve stem, a plug, a stopper, a second air seal, a spacer, and a biasing member, with the valve stem having a hollow shape and defining a first channel, with the valve stem defining a first stop edge, with the valve stem including a hole extended radially therethrough and in fluid communication with the first channel, with the plug inserted in an open end of the valve stem, with the plug selectively blocking fluid communication between the gas outlet mechanism and the passage, with the biasing member retained between the spacer and the first stop edge, with the stopper having a hollow shape and defining a second channel, with the valve stem inserted through the second channel, with the stopper fixed to the main body, and with the stopper defining a second stop edge and the second air seal retained between the second stop edge and the spacer.

8. The device as claimed in claim 1, wherein the main body defines a first adjustment portion and the adjustably movable valve defines a second adjustment portion respectively, with an inner thread defining the first adjustment portion and an outer thread defining the second adjustment portion respectively, and with the first and second adjustment portions engaged with each other such that the adjustably movable valve has various relative positions with respect to the main body.

9. The device as claimed in claim 1, wherein the gas inlet and flow rate adjusting mechanism includes a soft member disposed in the first chamber, wherein the soft member is made of foam, wherein the adjustably movable valve is adjustably mounted on the main body, and wherein the soft member is depressible by the adjustably movable valve to have various heights and density, with different heights determining the flow rate of vaporized gas in the gas outlet mechanism.

10. The device as claimed in claim 9, wherein the gas inlet and flow rate adjusting mechanism includes a hard member disposed in the first chamber, wherein the hard member is made of copper, and wherein the adjustably movable valve includes a surface defining a pressing end, with the pressing end abutted against the hard member and the hard member abutted against the soft member respectively.

11. The device as claimed in claim 9, wherein the first air seal is mounted on an outer periphery of the adjustably movable valve, with the adjustably movable valve including a groove extended thereon and receiving the first air seal, and wherein the first chamber defines a compartment having a constant diameter, with the first air seal received in the compartment and movable therein when the adjustably movable valve is adjusted.

12. The device as claimed in claim 1, wherein the first air seal is mounted on an outer periphery of the adjustably movable valve, with the adjustably movable valve including a groove extended thereon and receiving the first air seal, and wherein the first chamber defines a compartment having a constant diameter, with the first air seal received in the compartment and movable therein when the adjustably movable valve is adjusted.

13. The device as claimed in claim 12, wherein the gas outlet mechanism includes a valve stem, a plug, a stopper, a second air seal, a spacer, and a biasing member, with the valve stem having a hollow shape and defining a first channel, with the valve stem defining a first stop edge, with the valve stem including a hole extended radially therethrough and in fluid communication with the first channel, with the plug inserted in an open end of the valve stem, with the plug selectively blocking fluid communication between the gas outlet mechanism and the passage, with the biasing member retained between the spacer and the first stop edge, with the stopper having a hollow shape and defining a second channel, with the valve stem inserted through the second channel, with the stopper fixed to the main body, and with the stopper defining a second stop edge and the second air seal retained between the second stop edge and the spacer.

14. The device as claimed in claim 13, wherein the main body defines a first adjustment portion and the adjustably movable valve defines a second adjustment portion respectively, with an inner thread defining the first adjustment portion and an outer thread defining the second adjustment portion respectively, and with the first and second adjustment portions engaged with each other such that the adjustably movable valve has various relative positions with respect to the main body.

* * * * *